United States Patent [19]

Antone

[11] 4,098,503

[45] Jul. 4, 1978

[54] ONE-HAND BAT

[76] Inventor: Howard J. Antone, 12284 Adine Ct., Glen Ellen, Calif. 95442

[21] Appl. No.: 732,723

[22] Filed: Oct. 15, 1976

[51] Int. Cl.[2] ..... A63B 69/40

[52] U.S. Cl. ..... 273/26 C; 273/26 B; 273/67 B; 224/28 A; 273/84 R

[58] Field of Search ..... 273/26 R, 26 B, 26 C, 273/67 R, 67 B, 67 C, 67 D, 67 DB, 72 R, 73 R, 81 D, 166, 81.2, 77, 67; 280/11.37 H, 11.37 D; 294/1 R, 25; 224/0.5, 5 R, 5 A, 5 B, 5 C, 5 D, 5 E, 5 F, 5 G.45, 49, 51, 52–55, 58, 7, 28

[56] References Cited

U.S. PATENT DOCUMENTS

| | | | |
|---|---|---|---|
| 400,354 | 3/1889 | Morris | 273/72 |
| 442,046 | 12/1890 | Heighington | 273/67 D |
| 2,169,774 | 8/1939 | Taylor | 273/72 |
| 3,113,782 | 12/1963 | Guier | 273/26 B |
| 3,829,276 | 7/1974 | Adelmann | 280/11.37 H |
| 3,880,423 | 4/1975 | Kreag | 273/72 R X |
| 3,957,267 | 5/1976 | Vitalo | 273/26 C |

FOREIGN PATENT DOCUMENTS

| | | | |
|---|---|---|---|
| 966,365 | 10/1950 | France | 280/11.37 H |

*Primary Examiner*—Richard C. Pinkham
*Assistant Examiner*—T. Brown
*Attorney, Agent, or Firm*—Naylor, Neal & Uilkema

[57] ABSTRACT

A one-hand bat for baseball practice and related usage in other sports is provided with a short length, a greater ball-contacting area, and a pair of parallel, adjacently disposed, double ended, flexible straps extending lengthwise of the grip portion of the bat, each strap being fastened at each of its ends to the grip portion through which the hand is inserted and by which the hand is connected against accidental disengagement from the grip of the bat. An adjustable slide is carried by both of the straps intermediate the fastened ends thereof and enabling the straps to be adjustably disposed in enclosing and entrapping relation to the user's hand when it is inserted between the straps and positioned beneath the straps in gripping relation to the grip portion of the bat.

3 Claims, 4 Drawing Figures

ONE-HAND BAT

SUMMARY OF THE INVENTION

The bat of the invention is particularly adapted for use for fielding practice in connection with baseball. The bat is particularly suitable for the rapid fire hitting of grounders to infielders during the traditional, pre-game warm-up practice.

An object of the invention is to provide a one-hand bat which has a shorter length but a greater ball hitting surface than the conventional baseball bat to enable a decrease in the number of missed and miss-hit balls.

Another object of the invention is to provide such a bat with a novel strap or cord connector means which serves the twofold purpose of attaching the bat to the hand and wrist of the user to prevent it from slipping out of the one-hand grasp of the batter and of so orienting the hand to the bat that the ball engaging surface of the bat is in a properly disposed attitude for the hitting of the ball.

These and other objects and advantages of the invention will be apparent from the following description taken in conjunction with the drawing forming part of this specification, and in which.

DESCRIPTION OF THE INVENTION

Figure 1:
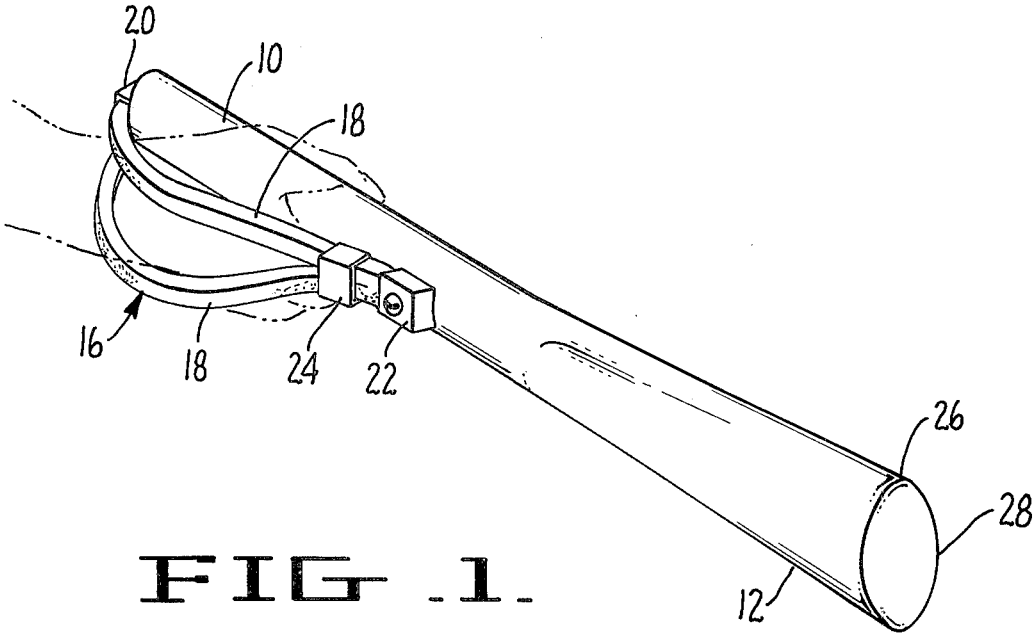
FIG. 1 is a view in perspective of the bat of the invention.
Figure 2:
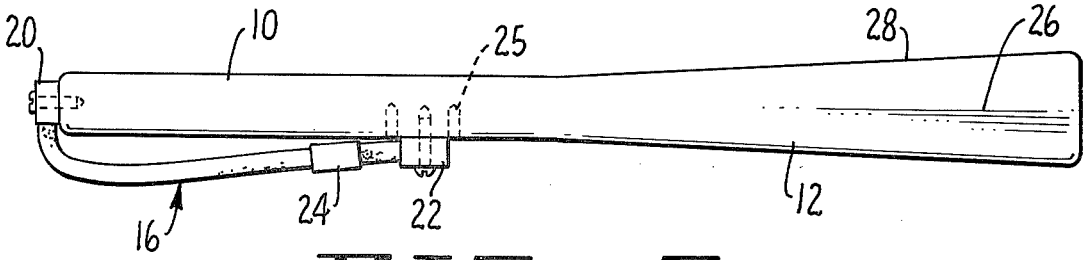
FIG. 2 is a plan view of the bat.
Figure 3:
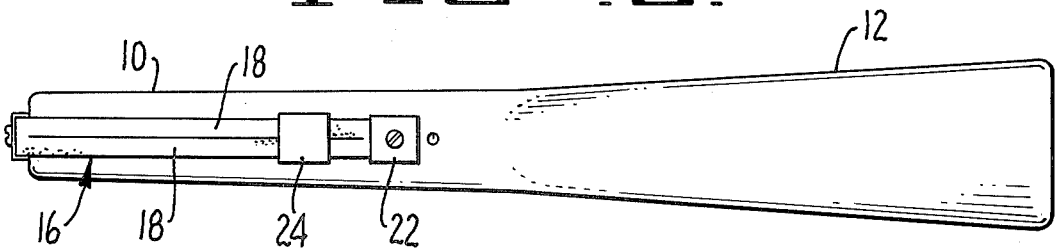
FIG. 3 is an elevational view of the bat.
Figure 4:
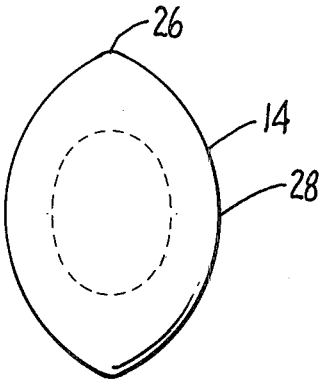
FIG. 4 is an end view of the bat.

The bat comprises a handle 10 and a barrel 12, the latter being somewhat elliptical in cross-section so as to provide a ball hitting surface 14 having a much greater than normal effective hitting area. That is to say, with respect to the longitudinal central axis of the bat, the surface 14 is not cylindrical with respect to said axis, but has instead a marked or substantial ellipticity which, in effect, gives it a greater than normal radius of curvature and consequently a greater than normal ball-striking area or surface. The grip 10 is provided with a hand connector indicated generally at 16 and comprising a bifurcated strap 18 having one end connected to the end of the grip by fastener means 20 and having the other end connected to the bat by fastener means 22. A slide member 24 is selectively positionable along the strap so as to snugly relate the strap to the hand of the user which encompasses and grips the grip part 10 of the bat. It will be appreciated that the user's hand is inserted between the bifurcated strap parts and placed around the grip. The slide 24 is then moved to the left (FIG. 3) to foreclose the hand from being pulled free of the bat and outwardly between the bifurcated strap parts should the hand of the bat user slip to an open position on the grip during use of the bat.

When the hand is placed on the grip so that the back of the hand is oppositely disposed with respect to the ball-hitting surface 28 and the connector is tightly related to the hand by the sliding of the member 24 to the left (FIG. 3), the hand and bat are correctly oriented with respect to each other.

With the subject bat, the user may catch return balls with his free hand and knock them back to the fielders during practice with a minimum of misses and miss-hits due to the greater ball hitting area of surface 14 of the barrel and to the fact that the connector 16 serves as a constraint to maintain the hand in connected relation to the grip and the hand in properly oriented relation to the highline or centerline 28 which extends longitudinally of the barrel along the hitting area 14.

The bat is provided with a plurality, preferably three, of internally threaded sockets 25 for the selective positioning of the fastener means 22 in accordance with the size (large, medium, small) of the user's hand to be enclosed.

The preferred materials for the connector 16 are leather strapping and elastic shock cord.

A typical length for this one-hand bat is from 21 to 23 inches for use in connection with baseball fielding practice.

One-hand bats or tools or devices embodying the hand connector means of the invention may be tennis racquets, hammers, pool cues, and various other items which may be advantageously connected to the hand for movement therewith during use.

What is claimed is:

1. In combination, a tool adapted to be manually gripped and manipulated with one hand, said tool having a grip portion, and connector means carried by the grip portion comprising a pair of double-ended flexible strap members adjacently disposed, extending lengthwise of said grip portion, and each fastened at both ends to said grip portion, and an adjustable slide jointly carried by said strap members intermediate the fastened ends thereof enabling said members to be disposed in enclosing and entrapping relation to the user's hand when it is inserted between said strap members and positioned beneath said strap members in gripping relation to said grip portion.

2. A one-hand ball bat comprising a grip portion and a barrel portion, said latter portion having a ball-striking surface which, as compared to the cylindrical ball-striking surface of a conventional baseball bat, has a substantially greater radius of curvature to thereby minimize misses and miss-hits during use, and connector means carried by the grip portion operable to maintain the bat and a user's hand in connected relation to each other, said connector means comprising a pair of double-ended flexible strap members adjacently disposed, extending lengthwise of said grip portion, and each fastened at both ends to said grip portion, and an adjustable slide jointly carried by said strap members intermediate the fastened ends thereof enabling said members to be disposed in enclosing and entrapping relation to the user's hand when it is inserted between said strap members and positioned beneath said strap members in gripping relation to said grip portion.

3. A one-hand ball bat comprising a grip portion and a barrel portion, said latter portion having a ball-striking surface which, as compared to the cylindrical ball-striking surface of a conventional baseball bat, has a substantially greater radius of curvature to thereby minimize misses and miss-hits during use, and connector means carried by the grip portion operable to maintain the bat and a user's hand in connected relation to each other such that the back of the user's hand is directed oppositely to the direction in which said ball-striking surface is disposed, said connector means comprising a pair of double-ended flexible strap members adjacently disposed, extending lengthwise of said grip portion, and each fastened at both ends to said grip portion, and an adjustable slide jointly carried by said strap members intermediate the fastened ends thereof enabling said members to be disposed in enclosing and entrapping relation to the user's hand when it is inserted between said strap members and positioned beneath said strap members in gripping relation to said grip portion.

* * * * *